United States Patent [19]

Karz

[11] Patent Number: 4,897,692

[45] Date of Patent: Jan. 30, 1990

[54] FAIL SAFE FUSER LAMP CONTROL

[75] Inventor: Robert S. Karz, Webster, N.Y.

[73] Assignee: Xerox Corporation, Stamford, Conn.

[21] Appl. No.: 179,369

[22] Filed: Apr. 8, 1988

[51] Int. Cl.[4] ..... G03G 15/20

[52] U.S. Cl. ..... 355/288; 219/216

[58] Field of Search ..... 355/14 FU, 3 FU, 30; 219/216, 469, 471, 502, 485; 432/60, 228; 118/60, 666; 315/127, 119, 74, 194; 328/144

[56] References Cited

U.S. PATENT DOCUMENTS

| | | | |
|---|---|---|---|
| 2,859,381 | 11/1958 | Gray et al. | 315/119 X |
| 3,211,950 | 10/1965 | Cardwell, Jr. | 315/74 |
| 3,346,768 | 10/1967 | Patsch | 315/119 X |
| 3,742,191 | 6/1973 | Poole et al. | 219/469 X |
| 3,833,794 | 9/1974 | Moriyama | 219/502 |
| 3,849,628 | 11/1974 | Abowitz et al. | 219/216 |
| 4,097,782 | 6/1978 | Chambliss | 315/194 X |
| 4,506,144 | 3/1985 | Hesford et al. | 328/144 X |
| 4,541,708 | 9/1985 | Shigenobu | 219/216 X |
| 4,556,779 | 12/1985 | Hashimoto et al. | 355/3 FU X |

FOREIGN PATENT DOCUMENTS

| | | | |
|---|---|---|---|
| 0111075 | 6/1984 | European Pat. Off. | 355/14 FU |
| 0079974 | 5/1982 | Japan | 355/14 FU |
| 0173772 | 10/1983 | Japan | 355/14 FU |
| 0154277 | 8/1985 | Japan | 355/14 FU |

*Primary Examiner*—Fred L. Braun
*Assistant Examiner*—Robert Beatty

[57] ABSTRACT

A heated fuser roll and control for fixing toner images to copy substrates. A light chopper adapted for rotation with the heated fuser roll generates signals which actuate a switch operably coupling a power source and a lamp for heating the fuser roll. The lamp is energized at maximum power at a duty cycle of 10% which provides for a fail-safe arrangement in the event the switch coupling the power source and the lamp short circuits which would result in overloading the lamp.

4 Claims, 1 Drawing Sheet

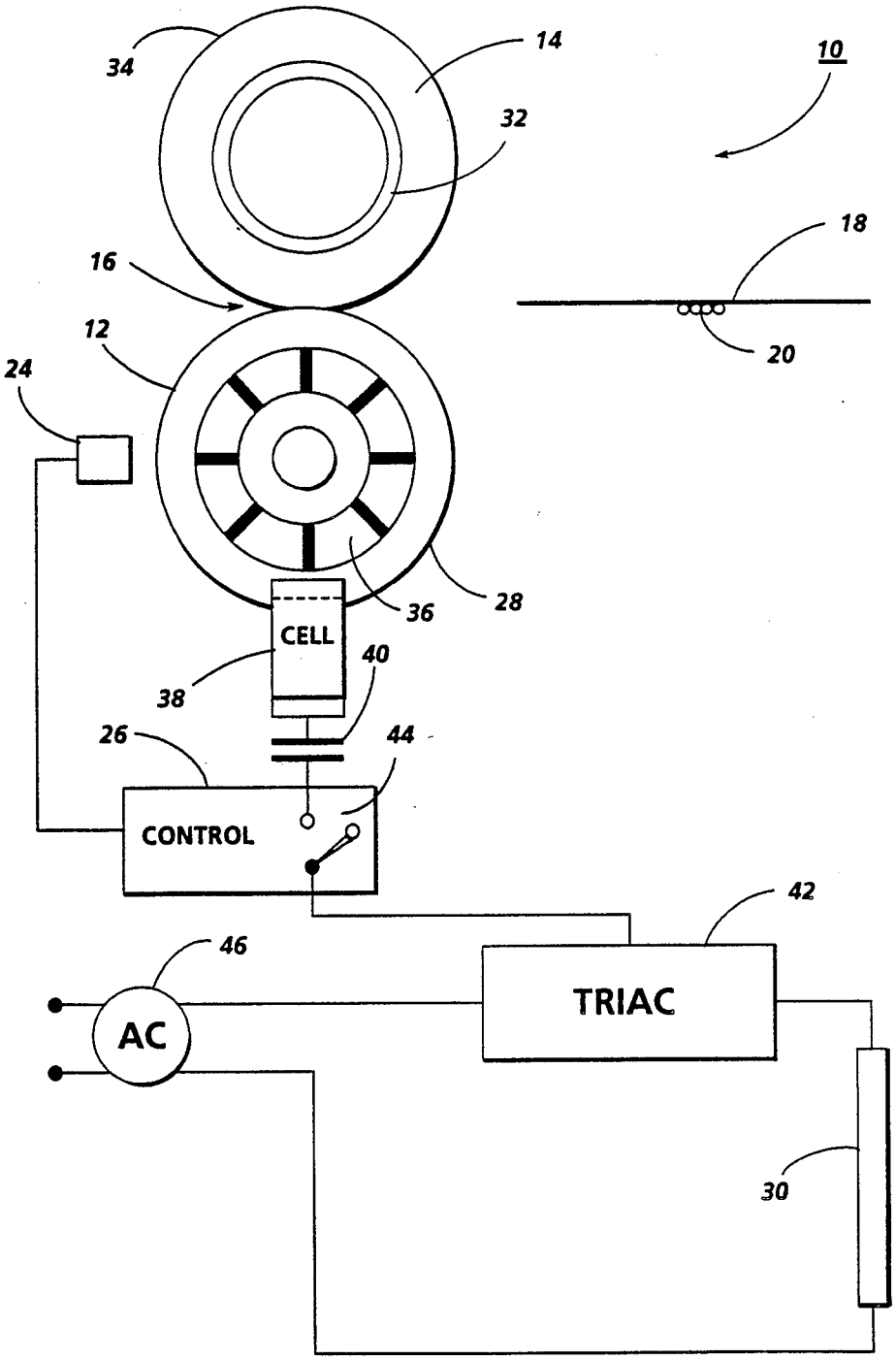
34
14
10
32
18
16
12
20
24
36
28
CELL
40
38
26
44
CONTROL
42
46
TRIAC
AC
30

FAIL SAFE FUSER LAMP CONTROL

BACKGROUND OF THE INVENTION

This invention relates generally to xerographic copying apparatus, and more particularly, it relates to the heat and pressure fixing of particulate thermoplastic toner by direct contact with an externally heated fusing member.

In the process of conventional xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which he constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roller thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner liquefy and cause a splitting action in the molten toner resulting in "hot offset." Splitting occurs when the cohesive forces holding the viscous toner mass together is less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting," has been to provide a fuser roll with an outer surface or covering of polytetrafluoroethylene, known by the tradename Teflon to which a release agent such as silicone oil is applied, the thickness of the Teflon being on the order of several mils and the thickness of the oil being less than 1 micron. Silicone based (polydimethylsiloxane) oils which possesses a relatively low surface energy, have been found to be materials that are suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of abhesive material to a rigid core or substrate such as the solid Teflon outer surface or covering of the aforementioned arrangement.

External fuser roll heating has been recognized to have substantial unit manufacturing cost (UMC) and size benefits over the more conventional internal roll heating methods for high speed application (≧about 600 mm per second). However, external fuser roll heating exhibits significantly increased fire risk as well. Thus, the viability of external heating of a fuser roll is dependent on the provision of a fail-safe method of insuring that a fire will not occur.

Most fuser roll temperature controllers use either a triac or two silicon controlled rectifiers (SCRs) to switch the lamp on and off. When a low level signal is supplied to these devices they become conductive and remain on (latched) until the current drops to zero. Since fuser lamps are powered by 60 Hz AC power, zero crossing occurs 120 per second. Thus, in normal operation, shutdown occurs within 1/120th of a second of loss of the control signal. The problem with these devices is that they often fail by short circuiting. In this case, the over-temperature sensor near the fuser roll would eventually shut down the fuser. However, such devices take tens of seconds to minutes to activate in the event of a triac or SCR failure, far too long for external heating. In addition, over-temperature sensors provide no protection should the fuser roll stop rotating.

BRIEF SUMMARY OF THE INVENTION

In accordance with the present invention, a slotted disk is attached to a fuser roll for use as an optical chopper that, in conjunction with a light sensor, delivers a string of electrical pulses only when the fuser roll is rotating. The pulses are conditioned by the selection of a slot width and/or use of a capacitance filter to insure that the pulses are shorter than the half cycle at 60 Hz (that is less than 1/120th of a second). In addition, the pulse frequency is much lower than the 60 Hz so the lamp duty cycle is low (e.g. less than 20%) and the lamp is energized less than one fifth of the half cycles. Zero crossing sensing circuitry could, of course be employed to reduce RF noise generated when a triac or SCR is activated mid cycle by delaying the turn-on command until the start of the next cycle.

Since a continuous string of pulses is required to keep the lamp energized, this method of control is fail-safe with respect to the fuser roll rotation. There is no way for the system to generate pulses once the fuser roll and its attached disk stall. It has the added advantage that, should the roll slow down, the average power delivered to the roll would be reduced proportionately.

In addition, the low duty cycle affords fail-safe protection in the event of triac or SCR shorting. This results because a fuser lamp filament is essentially a time averaging device for the time frames below a few tenths of seconds. Thus, a 10 volt lamp could be run either continuously at 10 volts or at 100 volts at a 10% duty cycle so long as the cycle times are short in comparison to the lamp filament's thermal time constant. In other words, the maximum period between switch activations is short relative to the characteristic thermal relaxation time of the filament so as to minimize filament fatigue due to thermal cycling. Preferably the lamp is specified for full power dissipation at a 10% duty cycle at 120 VAC so that it is significantly overloaded if the triac or SCRs were to short circuit and cause the duty cycle to effectively increase to 100%. The system would thus fail safely through relatively inexpensive lamp burn-out rather than by a potentially catastrophic fire.

DESCRIPTION OF THE DRAWINGS

The FIGURE is a side elevational schematic view of a heat and pressure fuser incorporating the present invention.

DETAILED DESCRIPTION OF THE PREFERRED EMBODIMENT OF THE INVENTION

Referring now to the FIGURE, it can be seen that the invention is directed to a roll fuser apparatus generally indicated 10. The fuser apparatus shown comprises an externally heated roll structure 12 cooperating with a non-heated backup or pressure roll structure 14 to form a nip 16 through which a copy substrate 18 passes with toner images 20 formed thereon in a well known manner. However, this invention pertains to an internally heated roll structure as well. The toner images 20 contact the heated roll structure while a force is applied between the roll structures in a conventional manner to create pressure therebetween resulting in the deformation of the fuser roll structure by the pressure roll structure to thereby form the nip 16.

As the substrate passes out of the nip 16, it is stripped from the heated roll structure by a stripping device (not shown) after which it is free to move along a predetermined path toward the exit of the machine (not shown) in which the fuser apparatus 10 is to be utilized.

A temperature sensor 24 is provided for sensing for surface temperature of the externally heated roll structure 12 and in conjunction with conventional control 26 maintains the surface temperature at a predetermined value, for example, in order of 375°–400° F. The heated roll structure 12 comprises a cylinder 28 having an external heat lamp 30 and reflector (not shown) adjacent the outer surface of said heated roll structure. When suitably energized via the aforementioned control, the heating element radiates heat to an outer surface of the structure 12 which preferably comprises silicone or VITRON TM (trademark of E. I. du Pont de Nemours & Co.) rubber having a thickness in the range 0.010 in. to about 0.100 in.

The backup roll structure 14 comprises a solid metal core 32 to which can be adhered a relatively thick layer 34 of deformable material for example an elastomer known as ethylene-propylene terpolymer which is based on stereosperific linear polymers of ethylene, propylene and small amounts of non-conjugated diene which is commonly referred to as EPDM which layer carries a thin overcoat of PFA. PFA is a fluorinated copolymer of perfluoroalkoxy and tetrafluoroethylene. Due to the construction of the backup roll structure shown it is deformed by the harder heated roll structure 12 when the required pressure is applied therebetween, the pressure being a function of the desired deformation which corresponds to the desired length of the nip 16. The invention can also be used in a fuser wherein the fuser roll is deformed by the pressure.

A slotted disk 36 is attached to the fuser roll serves as an optical chopper that, in conjunction with a light sensor or photocell 38, delivers a string of electrical pulses only when the fuser roll is rotating. The pulses are conditioned by a capacitance filter 40 to insure that the pulses are shorter than the half cycle at 60 Hz (that is less than 1/120th of a second). Proper selection of the slot widths of the chopper can also be used to condition the pulses. In addition, the pulse frequency is much lower than the 60 Hz so the lamp duty cycle is low (e.g. less than 20%) and the lamp is energized less than one fifth of the half cycles. The conditioned pulses are fed to a triac 42 via the electronic switch 44 which is part of the temperature control circuitry and which is activated when the roll temperature falls below the predetermined temperature set point. The triac operatively connects an AC power source 46 with the external heat lamp 30. Zero crossing sensing circuitry could, of course be employed to reduce RF noise generated by when the triac is activated mid cycle by delaying the turn-on command until the start of the next cycle.

Since a continuous string of pulses is required to keep the lamp energized, this method of control is fail-safe with respect to the fuser roll rotation. There is no way for the system to generate pulses once the fuser roll and its attached disk stall. It has the added advantage that, should the roll slow down, the average power delivered to the roll would be reduced proportionately.

In addition, the low duty cycle affords fail-safe protection in the event of a triac or SCR short circuit. This results because a fuser lamp filament is essentially a time averaging device for the time frames below a few tenths of seconds. Thus, a 10 volt lamp could be run either continuously at 10 volts or at 100 volts at a 10% duty cycle so long as the cycle times are short in comparison to the lamp filament's thermal time constant. This time constant is the time required for the lamp filament to cool to 1/e of its operating temperature referenced to the ambient temperature once the power is interrupted. Expressed mathematically, this is the time for the temperature to reach $$Ta+(To-Ta)/e$$

where Ta is the ambient temperature, To is the filament operating temperature, and e is the natural logarithm. Preferably the lamp is specified for full power dissipation at a 10% duty cycle at 120 VAC so that it would be significantly overloaded should the triac short circuit and cause the duty cycle to effectively increase to 100%. The system would thus fail safely through relatively inexpensive lamp burn-out rather than by a potentially catastrophic fire.

What is claimed is:

1. In a contact fuser apparatus having a heated roll structure rotating in contact with a backup roll structure and forming a nip therewith through which copy substrates carrying toner images pass with the toner images contacting the heated fuser roll structure, the improvement comprising:

a heat lamp for elevating the temperature of said heated roll structure;

switching means operably coupling said heat lamp and a source of alternating power; and means for periodically actuating said switch means for effecting operation of said heat lamp at approximately full power dissipation at a duty cycle low enough to prevent overloading of said heat lamp whereby any circuit failure causing continuous lamp energization will result in power interruption and safe shutdown through lamp filament failure before fire or overheating can occur;

said means for periodically actuating said switch means comprising means responsive to the rotation of one of said roll structures for generating electrical signals indicative of roll structure rotation and the maximum frequency of said means for periodically actuating said switch means being low relative to the frequency of the alternating current energizing the lamp so that the maximum time average power dissipation does not exceed the lamp power rating.

2. Apparatus according to claim 1 wherein said means responsive to the rotation of one of said roll structures for generating electrical signals indicative of roll structure rotation comprises a slotted disk carried by one of said roll structures and a photocell.

3. Apparatus according to claim 2 including means for conditioning said signals so that they have a duration of less than the alternating current half cycle period.

4. Apparatus according to claim 2 wherein said current half cycle is 1/120 of a second.

* * * * *